US005099592A

United States Patent [19]

Layne

[11] Patent Number: 5,099,592

[45] Date of Patent: Mar. 31, 1992

[54] ILLUMINATED SIGN

[75] Inventor: Clifford J. Layne, Toronto, Canada

[73] Assignee: Noma Inc., Scarborough, Canada

[21] Appl. No.: 650,534

[22] Filed: Feb. 5, 1991

[51] Int. Cl.[5] ..... G09F 13/00

[52] U.S. Cl. ..... 40/540; 248/156; 248/545

[58] Field of Search ..... 40/540, 579, 580, 574, 40/604, 602; 439/567, 571, 666, 667, 527; 362/249, 396, 382, 375, 362; 248/156, 545

[56] References Cited

U.S. PATENT DOCUMENTS

| | | | |
|---|---|---|---|
| 736,506 | 8/1903 | Duket | 40/540 |
| 1,292,400 | 1/1919 | MacCarthy | 40/573 |
| 1,784,937 | 12/1930 | Kreslowsky | 40/540 |
| 2,172,347 | 9/1939 | Clemence | 439/667 |
| 2,465,034 | 3/1949 | Peters | 40/574 |
| 3,189,740 | 6/1965 | Wince | 362/375 |
| 3,219,010 | 11/1965 | Hyatts | 40/602 |
| 3,220,130 | 11/1965 | Falkenberg | 40/540 |
| 3,228,286 | 1/1966 | Jaris | 362/362 |
| 4,456,946 | 6/1984 | Brower | 362/375 |
| 4,538,217 | 8/1985 | Ewing et al. | 362/362 |

FOREIGN PATENT DOCUMENTS

| | | | |
|---|---|---|---|
| 544584 | 6/1956 | Italy | 40/540 |

*Primary Examiner*—Kenneth J. Dorner
*Assistant Examiner*—Cassandra Hope
*Attorney, Agent, or Firm*—Kenneth M. Garrett

[57] ABSTRACT

An illuminated sign comprises front and back sheets central portions of which are generally planar. The front sheet carries design elements thereon certain of which are intended to be highlighted. The back sheet has portals therein generally opposed to the areas to be highlighted and which are closed by flaps which may form a unitary part of the back sheet. The portals provide access to lamps contained within the sign. The sign is easily mounted from a ground surface and is economic to manufacture for use as a seasonal decoration.

20 Claims, 2 Drawing Sheets

FIG. 4.
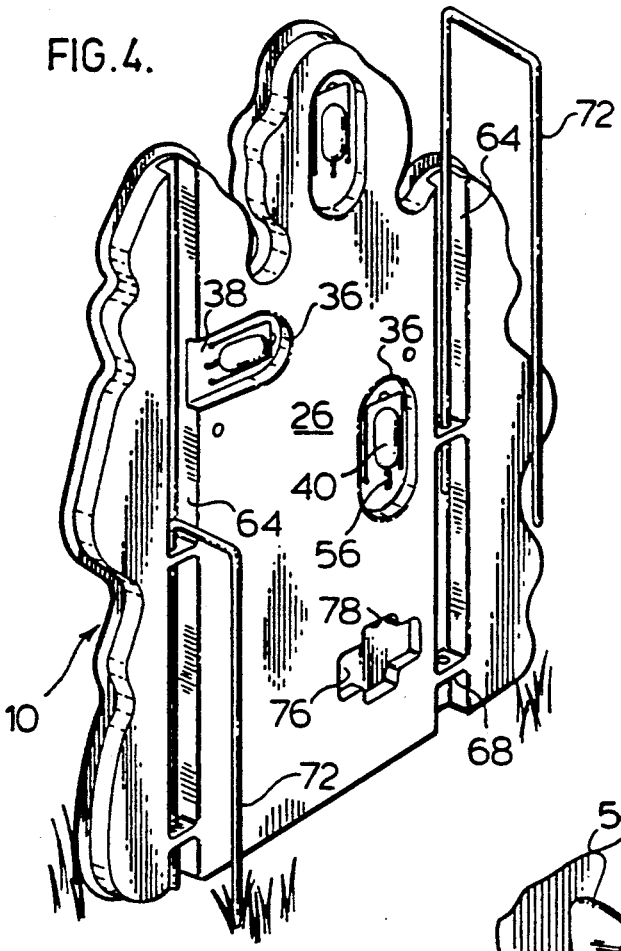
FIG. 5.
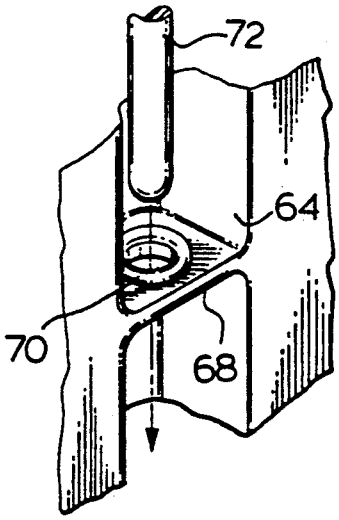
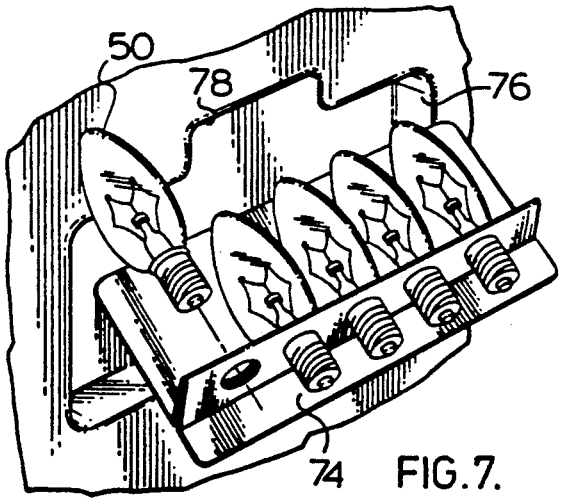
FIG. 7.
FIG. 6.
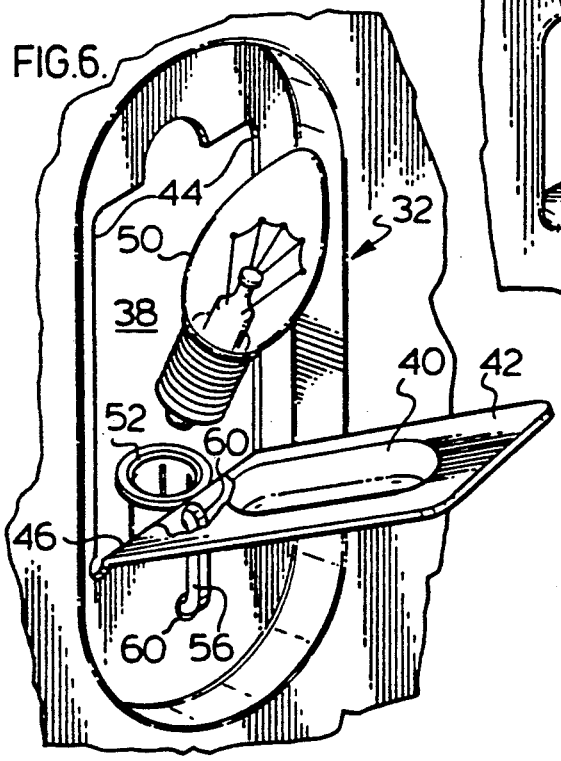

ILLUMINATED SIGN

FIELD OF INVENTION

This invention relates to illuminated signs. It is particularly described in relation to illuminated decorative signs, such as may typically be intended for use on festive occasions such as Christmas, Easter and Halloween, but it is not limited thereto.

BACKGROUND OF INVENTION

Illuminated decorative signs are well known but have in the past been physically quite large in three dimensions. Such signs are expensive to produce and transport, and by their nature require a considerable floor space for stocking by retailers and storage by householders between seasons, and for these reasons have not proved to be popular items in commerce.

Certain areas of signs will have a greater interest than other areas. It is therefor desirable to provide an easy and economic manner of highlighting a plurality of different areas which may be spaced apart over the sign, or which may be grouped together, or combinations thereof.

It is required to provide means for replacing lamps within the illuminated signs. In the more economic signs of the prior art, it is necessary that they be substantially disassembled in order to replace lamps or to carry out other maintenance. In more expensive signs which are of a more permanent nature it is known to provide access openings that may be removed. In either case it is usually required to use tools for this purpose.

A further problem with signs relates to their erection. The signs contemplated herein are very light, and have a large surface area. Where used outdoors in an exposed located it is desirable that they be well secured. Since many such signs will be used as Christmas decorations and may be erected when ground surfaces are frozen, it is desirable that the erection means facilitates such manner of use.

A still further problem relates to the packaging of the lamps together with the sign for shipping purposes, as the lamps are normally required to be inserted into the sign by the user.

It is an object of this invention to provide illuminated signs that are economic to produce, attractive in appearance and which may be large in two dimensions but which may be small in the third dimension.

It is another object of this invention to provide signs in which selected portions thereof may be highlighted by illumination from within.

It is a further object of this invention to provide illuminated signs that give access to the interior thereof without the use of tools and/or expensive structural additions to the sign.

It is a further object of the invention to provide illuminated signs that are easily erected from a ground surface.

SUMMARY OF INVENTION

In accordance with one aspect of the invention, an illuminated, decorative sign comprises a front sheet of material having a design carried thereon, and a back sheet. Means is provided to join the sheets together adjacent their peripheries, with central portions spaced apart so as to enclose a space therebetween. A plurality of lamp sockets is provided, and means for mounting the sockets to the back sheet within the enclosed space. The back sheet is provided with a plurality of portals therein respectively associated with the sockets to provide access thereto, and a plurality of flaps is provided in the back sheet respectively associated with the portals for closing same.

Suitably, the central portions of the sheets are generally planar and parallel. Also suitably, the sheets have a planar margin adjacent the periphery which defines a datum plane, and the central portions of the back sheet are deformed backwardly of the datum plane. Conveniently, central portions of the front sheet may be deformed forwardly of the datum plane, particularly where the front sheet is somewhat undulated to emphasise design features thereon. Commonly such design features include or are intended to incorporate portions of greater interest than other portions of the design. Such portions of interest are readily highlighted by locating the lamp sockets in general opposition thereto.

Desirably the locations of the lamp sockets and their associated portals are defined by pockets recessed in the back sheet forwardly of the plane of central portions thereof. Conveniently, the flaps are unitary with the back wall, and are formed by slitting partly around the circumference of the flap so as to form in effect a tongue connected to the pocket wall by a live hinge.

Conveniently, and as is known in the Christmas tree lighting art, each lamp socket is provided with an integral hook, and the back sheet is provided with one or more small openings adjacent each flap through which the hook may be threaded to secure the socket to the back wall.

Central portions of the back sheet may further have two or more elongated, vertically oriented, forwardly recessed channels therein, bridged by walls at intervals therealong, which walls have an opening therethrough. The arrangement permits a spike or the like to be passed through these wall openings and driven into a ground surface for retaining the sign thereon.

Another central portion of the back sheet is conveniently provided with a rectangular recess, into which may be fitted and retained by friction a standard sleeve carrying lamps, for storage of the lamps for shipping purposes.

These foregoing objects and aspects of the invention, together with other objects, aspects and advantages thereof will be more apparent from the following description of a preferred embodiment thereof, taken in conjunction with the following drawings.

BRIEF DESCRIPTION OF THE DRAWINGS

FIG. 4—shows the sign in perspective view from the rear and a manner of erecting the sign on a ground surface;

FIG. 5—is a detail view in the area 5—5 of FIG. 3;

FIG. 6—is a detail view in the area 6—6 of FIG. 4, with a flap shown in the open position and partially broken away to reveal further detail, and FIG. 7—is a perspective view of a lamp storage compartment showing the lamps partially removed therefrom.

DESCRIPTION OF THE PREFERRED EMBODIMENT

Figure 1:
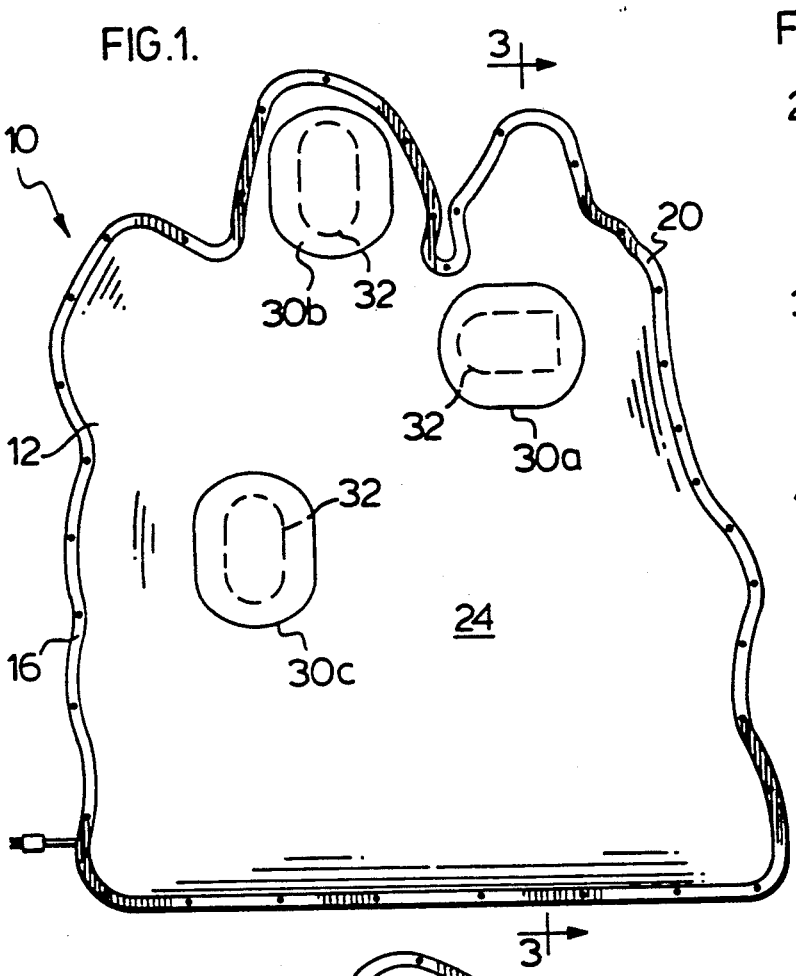
FIG. 1—shows in front elevation a decorative sign in accordance with the invention, with a hidden portion shown in dashed outline.
Figure 3:
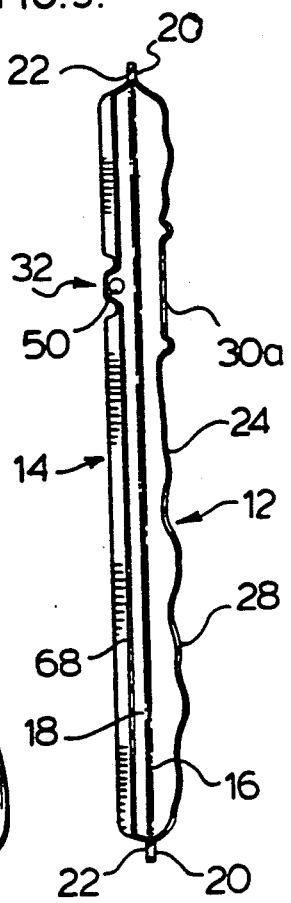
FIG. 3—is a section on 3—3 of FIG. 1.
Figure 2:
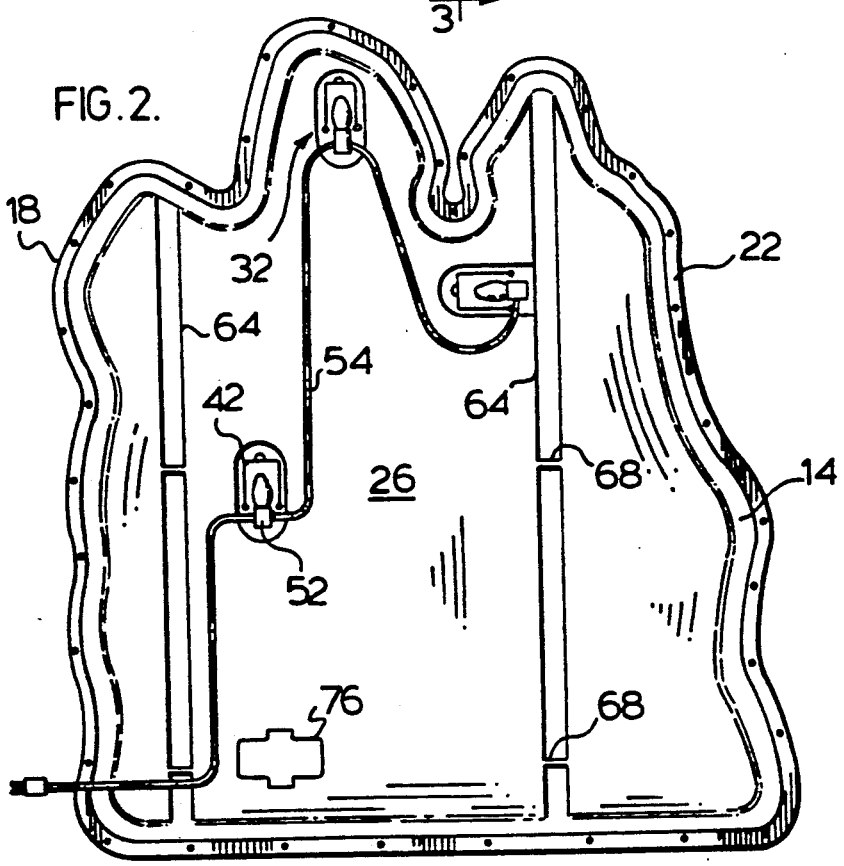
FIG. 2—shows in front elevation the back face of the sign of FIG. 1, as seen from the interior thereof.

Sign 10 comprises a front sheet 12 and a back sheet 14 each of which respectively has a periphery 16, 18 and a peripheral margin 20, 22 circumscribing a central portion 24, 26 thereof. Central portions 24, 26 are contained in planes that are generally parallel and that are spaced apart, conveniently by deforming sheet 12 forwardly and sheet 14 rearwardly adjacent their peripheral margins 20, 22, which identify a datum plane so as to enclose a space between the sheets.

Front sheet 12 has a design (not shown) carried thereon, and periphery 16 is suitably contoured to complement the design; a somewhat arbitrary contour is illustrated, although it may be preferred, as herein, that the bottom portion thereof provide a horizontal base to facilitate the erection of sign 10 on a ground surface.

The design carried on front sheet 12 may additionally or alternatively be complemented for example by undulating the central portion 24 of front sheet 12 or parts thereof, so as to provide a three dimensional relief to the design; the undulations 28 are relatively shallow, and for the purpose of the description, central portion 24 is still considered to be generally planar. The design carried on front sheet 12 will typically include certain areas of greater graphic interest than other areas, here three such areas 30*a*, 30*b*, and 30*c* being shown by way of example. Each area 30*a*, 30*b* and 30*c* has associated therewith in general opposition thereto a means 32 for highlighting the area. Highlighting means 32 includes a pocket 36 formed in back sheet 12 forwardly recessed from the plane of central portion 26 thereof. Pockets 36 include a generally planar forward wall portion 38, in which forward wall portion there is centrally located a rearwardly dished elongated recess 40. A flap 42 is formed in wall portion 38 and lie within the same plane as portal 44, which extends about three sides of the flap, the fourth, non-slitted side forming a live hinge 46. Line 44 defines a portal opening, otherwise referred to as a portal into the space enclosed by sheets 12 and 14, to provide access to a lamp 50 associated with each pocket 36. Lamp 50 is conveniently a miniature screw base type commonly used for decorating Christmas trees, and is retained in a socket 52 therefor, which forms a part of a light string with an interconnecting cord 54. One or more of lamps 50 may be of a flashing type as is known in the art, to provide an intermittent illumination to an area to be highlighted, sign 10 may be animated.

It is contemplated that certain areas of front sheet 12 may be left with no design thereon, to permit the addition of a design in the blank area by a user of the sign. It should be understood that reference to a design carried on front sheet 12 includes designs that incorporate such blank areas. Conveniently the blank area or areas may be planar to permit the later addition of for example an image carried on film to be applied thereto at a later time, according to the precise purpose to which the illuminated sign is to be put. Such planar blank area may well be an area to be highlighted and will thus have a highlighting means 32 associated therewith, one such planar blank area being identified as 30*a*.

Socket 52 has a hook connector 56 unitarily formed therewith, and pocket wall portion 38 is provided with a pair of small openings 60 located on the major axis of elongated recess 40 below flap 42 where this is vertically oriented, or to one side thereof otherwise, through which openings 60 hook connector 56 is passed to retain the socket 52 in position without necessitating any additional means of securement.

A pair of elongated, vertically oriented forwardly recessed channels 64 are provided in back sheet 12. Each channel 64 is bridged at 68 at vertically spaced part intervals therealong; each bridge 68 has an opening therethrough reinforced by a grommet 70 through which a U-shaped metal stake 72 may be passed for securing sign 10 to a ground surface.

For shipping and storage purposes, lamps 50 are conveniently located on a carrier 74. Central portion 26 of back sheet 14 is provided with a generally rectangular recess 76 forwardly of the plane thereof into which carrier 74 is a friction fit around the peripheral margin thereof. Tab recesses 78 are provided along the upper and lower margins of rectangular recess 76 to facilitate the removal of carrier 74 from the storage recess 76.

The design carried on front sheet 12 may conveniently and desirably under most circumstances, particularly where it is intended to be a permanent design, be applied to the inner surface of the sheet so as to be protected from the elements. Conveniently, the design may be applied by printing techniques, which term includes without limitation lithographic, silk screening and photographic techniques, although other techniques for applying or creating the design may also be used as is convenient. Generally, it will be preferred to apply a design to sheet 12 before the sheet is deformed.

Sign 10 is suited for manufacture by vacuum forming sheet plastic material using relatively simple molds as is known in the art; for this purpose mold components such as those for forming channels 64 and pockets 36 may be preformed, and placed in the mold at desired locations in accordance with the areas 30 of the sign to be highlighted. Suitably back sheet 14 will be a relatively opaque material, preferably light coloured so as to form a reflector for lamps 50. Front sheet 12 is preferably of transparent material.

In that flaps 42 and their associate portals 44 provide adequate access for the servicing of lamps 50 contained within sign 10, the peripheral margins 20, 22 of sheets 12 and 14 may be secured together in a permanent manner if desired, for example by welding or stapling or by any other convenient means about the whole of the peripheral margins.

It will be apparent that many changes may be made to the illustrative embodiment, while falling within the scope of the invention and it is intended that all such changes be covered by the claims appended hereto.

I claim:

1. An illuminated decorative sign comprising:

a front sheet having a design carried thereon;

a back sheet; each said sheet having a periphery therearound; means located about the periphery of said sheets for joining them together with central portions in spaced apart relationship to enclose a space therebetween;

a plurality of lamp sockets;

means mounting said lamp sockets within said enclosed space;

said back sheet having a plurality of portals therein respectively associated with said sockets to provide access thereto, and a plurality of flaps connected to said back sheet respectively associated with said portals for closing same, central portions of said back sheet having at least one elongated, forward recess therein having at least a pair of bridges there across with an opening therethrough for attaching a stake to said sign.

2. An illuminated decorative sign as defined in claim 1, wherein central portions of each said sheet are generally planar and parallel.

3. An illuminated decorative sign as defined in claim 1, wherein each said sheet has a planar peripheral margin therearound, and wherein central portions of said back sheet are rearwardly deformed from the plane of said peripheral margin to thereby space said central portions of each said sheet apart.

4. An illuminated decorative sign as defined in claim 3, wherein there is provided a plurality of forwardly recessed pockets in said back sheet opening in the plane thereof.

5. An illuminated decorative sign as defined in claim 4, wherein said lamp sockets are mounted on said back sheet in portions thereof defining said pockets.

6. An illuminated decorative sign as defined in claim 4, wherein said portals are provided in said back sheet in portions thereof defining said pockets.

7. An illuminated decorative sign as defined in claim 1, wherein said lamp socket mounting means mounts said lamp sockets from said back sheet.

8. An illuminated decorative sign as defined in claim 7, wherein said front sheet includes at least one planar portion generally opposed to a said portal.

9. An illuminated decorative sign as defined in claim 1, wherein said flaps are connected to said back sheet by a live hinge.

10. An illuminated decorative sign as defined in claim 1, wherein said back sheet is provided with a pair of said elongated recesses in parallel relationship.

11. An illuminated decorative sign as defined in claim 1, wherein front sheet is formed from a transparent thermoplastic material.

12. An illuminated decorative sign as defined in claim 1, including a pair of wire conductors electrically connected to said sockets to form a string.

13. An illuminated decorative sign as defined in claim 1, wherein said means mounting said lamp sockets comprises a clip secured to each said socket, and wherein said back sheet has a small opening therethrough through which said clip passes.

14. An illuminated decorative sign as defined in claim 13, wherein said clip is unitarily formed with said socket.

15. An illuminated sign as defined in claim 1 further comprising at least one U-shaped metal stake for securing said sign to a ground surface.

16. An illuminated sign comprising:

front and back sheets, each said sheet having a planar peripheral margin therearound central portions of said back sheet being deformed rearwardly of said margin to lie in a plane generally parallel thereto;

a plurality of pockets recessed in said back sheet forwardly of the plane of said central portions thereof;

each said pocket having a flap unitarily formed therein;

each said flap defining an access opening generally sealed by said flap, and a plurality of lamp sockets;

each said socket comprising a hook portion, said back sheet having a small opening therethrough associated with each said flap opening through which small openings respective hook portions pass to secure said sockets to said back sheet on the interior of said sign, each said socket having an access opening associated therewith.

17. An illuminated sign as defined in claim 16, wherein said lamp sockets are electrically connected in a string.

18. An illuminated sign as defined in claim 16, wherein central portions of said front sheet are undulated and have a design applied to the interior surface thereof.

19. An illuminated sign as defined in claim 18, wherein at least one portion of said central portions of said front sheet is planar and is associated with at least one lamp socket generally opposed thereto.

20. An illuminated sign as defined in claim 16, wherein said central portion of said back sheet is provided with a lamp storage recess therein.

* * * * *